US010475378B2

(12) United States Patent
Lee

(10) Patent No.: US 10,475,378 B2
(45) Date of Patent: Nov. 12, 2019

(54) ORGANIC LIGHT EMITTING DISPLAY DEVICE AND METHOD OF DRIVING THE SAME

(71) Applicant: SAMSUNG DISPLAY CO., LTD., Yongin-si, Gyeonggi-do (KR)

(72) Inventor: Gil-Jae Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 260 days.

(21) Appl. No.: 15/208,396

(22) Filed: Jul. 12, 2016

(65) Prior Publication Data

US 2017/0032738 A1 Feb. 2, 2017

(30) Foreign Application Priority Data

Jul. 29, 2015 (KR) ..... 10-2015-0107091

(51) Int. Cl.
*G09G 3/3275* (2016.01)
*G09G 3/3233* (2016.01)

(52) U.S. Cl.
CPC ..... *G09G 3/3233* (2013.01); *G09G 3/3275* (2013.01); *G09G 2300/0819* (2013.01); *G09G 2300/0842* (2013.01); *G09G 2300/0861* (2013.01); *G09G 2320/0295* (2013.01); *G09G 2320/045* (2013.01)

(58) Field of Classification Search
CPC ..... G09G 3/3233; G09G 3/3275; G09G 2300/0819; G09G 2300/0861; G09G 2320/0295; G09G 2320/045
See application file for complete search history.

(56) References Cited

U.S. PATENT DOCUMENTS

2008/0316154 A1* 12/2008 Kim ..... G09G 3/3655 345/87
2011/0012882 A1* 1/2011 Jeong ..... G09G 3/3688 345/211
2014/0347332 A1* 11/2014 Lee ..... G09G 3/3233 345/204
2015/0061981 A1* 3/2015 Lee ..... G09G 3/3291 345/77
2016/0055791 A1* 2/2016 Kishi ..... G09G 3/3241 345/212

FOREIGN PATENT DOCUMENTS

KR 10-2014-0137218 A 12/2014

* cited by examiner

*Primary Examiner* — Towfiq Elahi
(74) *Attorney, Agent, or Firm* — Lewis Roca Rothgerber Christie LLP

(57) ABSTRACT

An organic light emitting display device includes a display panel including a pixel at an intersection of a data line, a feedback line, and a scan line; a data driver configured to provide a data signal to the pixel through the data line; and a sensing unit configured to generate a reference voltage based on the data signal, to generate first sensing data based on a sensing current that flows through the feedback line in response to the reference voltage, and to generate second sensing data by digital-converting the reference voltage.

20 Claims, 9 Drawing Sheets

ORGANIC LIGHT EMITTING DISPLAY DEVICE AND METHOD OF DRIVING THE SAME

CROSS-REFERENCE TO RELATED APPLICATION

This application claims priority to and the benefit of Korean Patent Application No. 10-2015-0107091, filed on Jul. 29, 2015 in the Korean Intellectual Property Office (KIPO), the content of which is incorporated herein in its entirety by reference.

BACKGROUND

1. Field

Example embodiments relate to an organic light emitting display device and a method of driving the same.

2. Description of the Related Art

An organic light emitting display device displays an image using an organic light emitting diode. Organic light emitting diodes and driving transistors that transfer current to the organic light emitting diodes within the organic light emitting display device may become degraded over time as the organic light emitting diodes are used. Thus, over time, the organic light emitting display device may not display images with the desired luminance due to degradation of the organic light emitting diodes or degradation of the driving transistors (e.g., referred to as "degradation of a pixel").

A related art organic light emitting display device may provide a reference voltage to a pixel, measure a current flowing through the pixel based on the reference voltage, and determine whether or not the pixel is degraded. However, because an operation point (or, an operation voltage level) of a pixel is not the same as an operation point (or, an operation voltage level) of another pixel, the related art organic light emitting display device may not be able to accurately determine, based on a sensed current when only one reference voltage (e.g., a reference voltage having an operation voltage level that is the same as an operation point of any pixel) is provided to the pixel, whether or not the pixel is degraded. In addition, because the related art organic light emitting display device may require a pixel initialization time for providing the reference voltage to the pixel (e.g., a time for initializing the pixel with the reference voltage), a time for measuring a current may be increased.

The above information disclosed in this Background section is only to enhance the understanding of the background of the disclosure, and therefore it may contain information that does not constitute prior art.

SUMMARY

Example embodiments of the present invention relate to an organic light emitting display device and a method of driving the same. For example, example embodiments of the present invention relate to an organic light emitting display device configured to sense a characteristic of a pixel and a method of driving the organic light emitting display device.

According to some example embodiments of the present invention, an organic light emitting display device may be enabled to measure a characteristic of a pixel by considering an operation point for each pixel.

Some example embodiments of the present invention include a method of driving the organic light emitting display device.

According to some example embodiments of the present invention, an organic light emitting display device includes: a display panel comprising a pixel at an intersection of a data line, a feedback line, and a scan line; a data driver configured to provide a data signal to the pixel through the data line; and a sensing unit configured to generate a reference voltage based on the data signal, to generate first sensing data based on a sensing current that flows through the feedback line in response to the reference voltage, and to generate second sensing data by digital-converting the reference voltage.

According to some embodiments, the sensing unit is configured to generate the reference voltage based on a node voltage at a node electrically connected to the pixel and the feedback line.

According to some embodiments, the sensing unit comprises: a reference voltage generator configured to generate the reference voltage based on the node voltage; an integrator configured to integrate the sensing current; and a first converter configured to convert an output signal of the integrator into the first sensing data.

According to some embodiments, the reference voltage generator is configured to sample the node voltage and to output a sampled node voltage as the reference voltage.

According to some embodiments, the reference voltage generator comprises a capacitor configured to store the node voltage.

According to some embodiments, the reference voltage generator comprises a buffer amplifier configured to receive the node voltage and to output the reference voltage.

According to some embodiments, the sensing unit further comprises: a second converter configured to generate the first sensing data.

According to some embodiments, the first converter is configured to generate the first sensing data in a first period and to generate the second sensing data in a second period different from the first period.

According to some embodiments, the integrator comprises: an amplifier comprising a first input terminal that is electrically connected to the feedback line, a second input terminal configured to receive the reference voltage, and an output terminal that is electrically connected to the first converter; and a second capacitor electrically connected between the first input terminal and the output terminal.

According to some embodiments, the integrator further comprises: a first switch electrically connected between the first input terminal and the output terminal, wherein the first switch is configured to be turned on in a reset period to discharge the second capacitor.

According to some embodiments, the pixel comprises: an organic light emitting diode electrically connected between a first node and a second power voltage; a switching transistor electrically connected between the data line and a second node, wherein the switching transistor is configured to be turned on in response to a scan signal; a storage capacitor electrically connected between a first power voltage and the second node; a driving transistor configured to provide the organic light emitting diode with a current based on a stored voltage in the storage capacitor; and a sensing transistor electrically connected between the feedback line and the first node, wherein the sensing transistor is configured to be turned on in response to a sensing control signal.

According to some embodiments, the pixel further comprises a second switch electrically connected between the driving transistor and the first node, wherein the second switch is configured to be turned on in a first sensing period.

According to some embodiments, the pixel further comprises a third switch electrically connected between the first node and the organic light emitting diode, wherein the third switch is configured to be turned on in a second sensing period.

According to some embodiments, the display device further includes a timing controller configured to generate compensation data to compensate degradation information of an organic light emitting diode of the pixel and deviation information of a threshold voltage of a driving transistor of the pixel based on the first sensing data and the second sensing data.

According to some embodiments, the timing controller comprises a memory configured to store the compensation data and is configured to correct the compensation data based on the first sensing data and the second sensing data.

According to some example embodiments of the present invention, in a method of driving an organic light emitting display device comprising a pixel at an intersection of a data line, a feedback line, and a scan line, the method includes: providing a data signal to the pixel through the data line; generating a reference voltage based on the data signal; generating second sensing data for the reference voltage; and generating first sensing data based on a sensing current that flows through the feedback line in response to the reference voltage.

According to some embodiments, the reference voltage is generated based on a node voltage applied to a node electrically connected to the pixel and the feedback line in response to the data signal.

According to some embodiments, generating the reference voltage comprises: sampling the node voltage; and outputting a sampled node voltage as the reference voltage.

According to some embodiments, the second sensing data is generated in a first period and the first sensing data is generated based on the sensing current in a second period different from the second period.

According to some embodiments, the method further includes generating compensation data to compensate degradation information of an organic light emitting diode of the pixel and deviation information of a threshold voltage of a driving transistor of the pixel based on the first sensing data and the second sensing data.

Therefore, an organic light emitting display device according to some example embodiments of the present invention may measure a characteristic of a pixel at an actual operation point by generating a reference voltage based on a data signal provided to the pixel and by measuring the characteristic of the pixel based on the reference voltage. As a result, the organic light emitting display device may reduce a sensing time for the pixel (e.g., a measuring time) because an operation for initializing the pixel is not performed by the organic light emitting display device.

In addition, a method of driving an organic light emitting display device according to example embodiments may effectively drive the organic light emitting display device.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
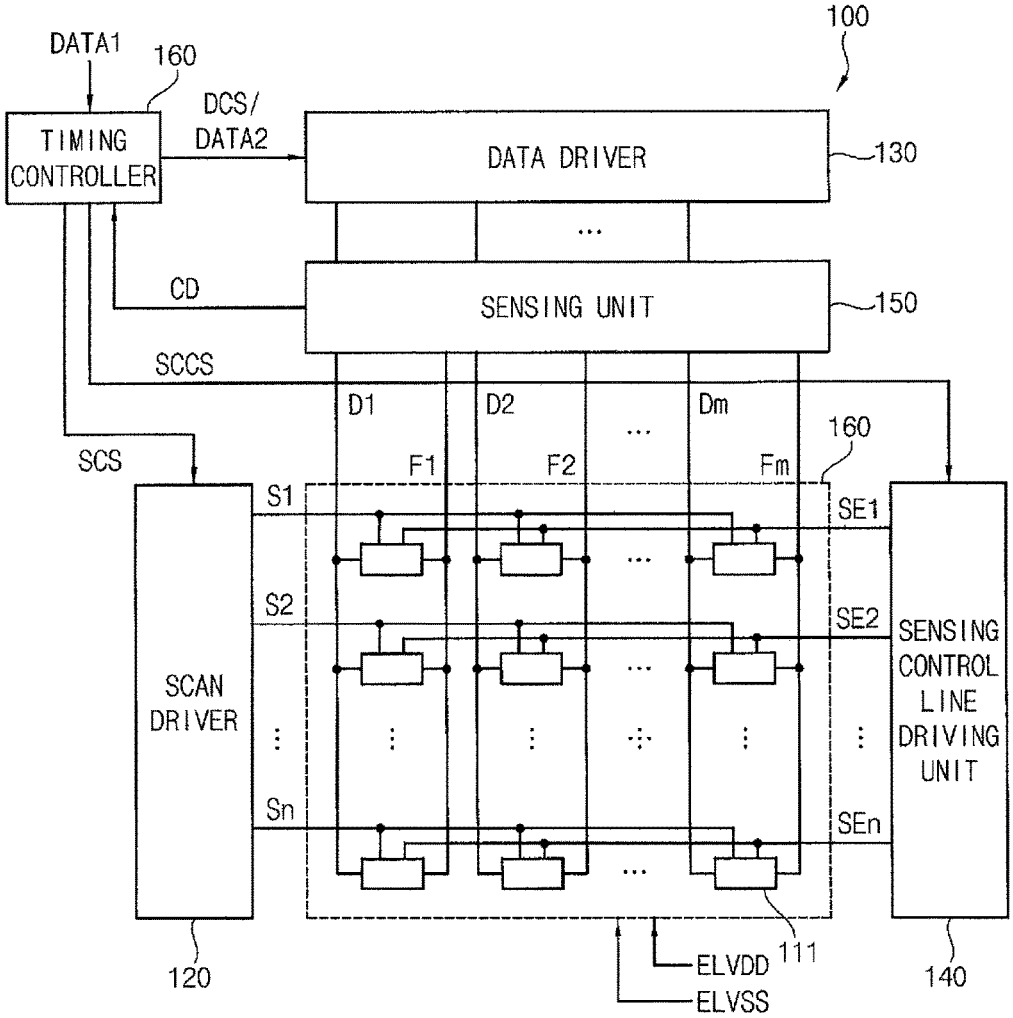
FIG. 1 is a block diagram illustrating an organic light emitting display device according to some example embodiments of the present invention.

Hereinafter, the present inventive concept will be explained in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating an organic light emitting display device according to some example embodiments of the present invention.

Referring to FIG. 1, the organic light emitting display device 100 may include a display panel 110, a scan driver 120, a data driver 130, a sensing control line driving unit 140, a sensing unit 150, and a timing controller 160. The organic light emitting display device 100 may display an image based on image data provided from an outside or external image data source.

The display panel 110 may include scan lines S1 through Sn, data lines D1 through Dm, sensing control lines SE1 through SEn, feedback lines F1 through Fm, and pixels 111. The pixels 111 may be respectively arranged at intersections of the scan lines S1 through Sn, the data lines D1 through Dm, the sensing control lines SE1 through SEn, and the feedback lines F1 through Fm, where each of m and n is an integer greater than or equal to 2.

Each of the pixels 111 may store a data signal in response to a scan signal, and may emit light based on a stored data signal. A configuration of the pixels 111 will be described in more detail with reference to FIG. 2.

The scan driver 120 may generate the scan signal based on the scan driving control signal SCS. The scan driving control signal SCS may be provided from the timing controller 160. The scan driving control signal SCS may include a start pulse and clock signals, and the scan driver 120 may include a shift register sequentially generating the scan signal based on the start pulse and the clock signals.

The data driver 130 may generate the data signal based on an image data (e.g., a second data DATA2). The data driver 130 may provide the data signal to the display panel 110. That is, the data driver 130 may provide the data signal to the pixels 111 through the data lines D1 through Dm. The data driving control signal may be provided from the timing controller 160 to the data driver 130.

The sensing control line driving unit 140 may generate a sensing control signal in response to a sensing control line driving control signal SCCS. The sensing control line driving control signal SCCS may be provided from the timing controller 160 to the sensing control line driving unit 140.

The sensing unit 150 may generate a reference voltage Vref based on the data signal, may sense (or, measure, detect) degradation information of an organic light emitting diode OLED included in each of the pixels 111 and threshold voltage/mobility information of a driving transistor included in each of the pixels 111, and may provide a sensing result SD to the timing controller 160. According to some example embodiments of the present invention, the sensing unit 150 may generate the reference voltage Vref based on the data signal, may generate first sensing data (ie.g., first sensing data for a certain pixel 111) based on a sensing current flowing through a feedback line (e.g., a feedback line among the feedback lines F1 through Fm that is electrically connected to the certain pixel 111) based on the reference voltage Vref, and may generate second sensing data by digital-converting the reference voltage Vref.

Here, the first sensing data may include the degradation information of the organic light emitting diode OLED and the threshold voltage/mobility information of the driving transistor, and the second sensing data may include information of an operation point (e.g., an actual operation point) of the pixel 111 that is used to generate the first sensing data. For example, the sensing unit 150 may sense the degradation information of the organic light emitting diode OLED during a first sensing period and may sense the threshold voltage/mobility information of the driving transistor during a second sensing period. A configuration of the sensing unit 150 will be described with reference to FIGS. 3A, 3B, and 5.

For reference, the first sensing period may be a period for sensing the degradation of the organic light emitting diode OLED included in the pixel 111. The second sensing period may be a period for sensing the threshold voltage/mobility of the driving transistor. A display period may be a period in which the pixel 111 emits light in response to the data signal, and a reset period may be a period for initializing the sensing unit 150 (e.g., discharging a second capacitor included in a integrator 320 of the sensing unit 150).

The timing controller 160 may control the scan driver 120, the data driver 130, the sensing control line driving unit 140, and the sensing unit 150. The timing controller 160 may generate the scan driving control signal SCS, the data driving control signal DCS, the sensing control line driving control signal SCCS, and the sensing control signal, and may control the scan driver 120, the data driver 130, the sensing control line driving unit 140, and the sensing unit 150 based on generated signals.

According to some example embodiments of the present invention, the timing controller 160 may generate a compensation data to compensate for degradation of the organic light emitting diode OLED and a variation of a threshold voltage/mobility of the driving transistor based on sensing data SD (e.g., the first sensing data and the second sensing data). The timing controller 160 may include a memory storing the compensation data that is predetermined (or, is pre-calculated), and may adjust (e.g., revise or update) the compensation data stored in the memory based on the sensing data SD (e.g., the first sensing data and the second data). The timing controller 160 may convert first data DATA1 into the second data DATA2 based on the compensation data, and may provide the second DATA2 to the data driver 130.

The organic light emitting display device 100 may further include a power supplier. The power supplier may generate a driving voltage (or, a power voltage) to drive the organic light emitting display device 100. The driving voltage may include a first power voltage ELVDD and a second power voltage ELVSS. The first power voltage ELVDD may have a higher voltage level than a voltage level of the second power voltage ELVSS.

As described above, the organic light emitting display device according to some example embodiments of the present invention may generate the reference voltage Vref based on the data signal provided to the pixel 111. Therefore, the organic light emitting display device 100 may sense a characteristic of the pixel 111 (e.g., the degradation information of the organic light emitting diode OLED and the threshold voltage/mobility information of the driving transistor) at an actual operation point (e.g., an operation point at which the pixel is actually driven). In addition, the organic light emitting display device 100 may need no initialization time for initializing the pixel 111 with the reference voltage Vref, because the organic light emitting display device 100 uses the reference voltage Vref that is generated based on the data signal already provided to the pixel 111. Therefore, the organic light emitting display device 100 may reduce a sensing time for sensing the characteristic of the pixel 111 and may sense the characteristic of the pixel 111 in real time.

Figure 2:
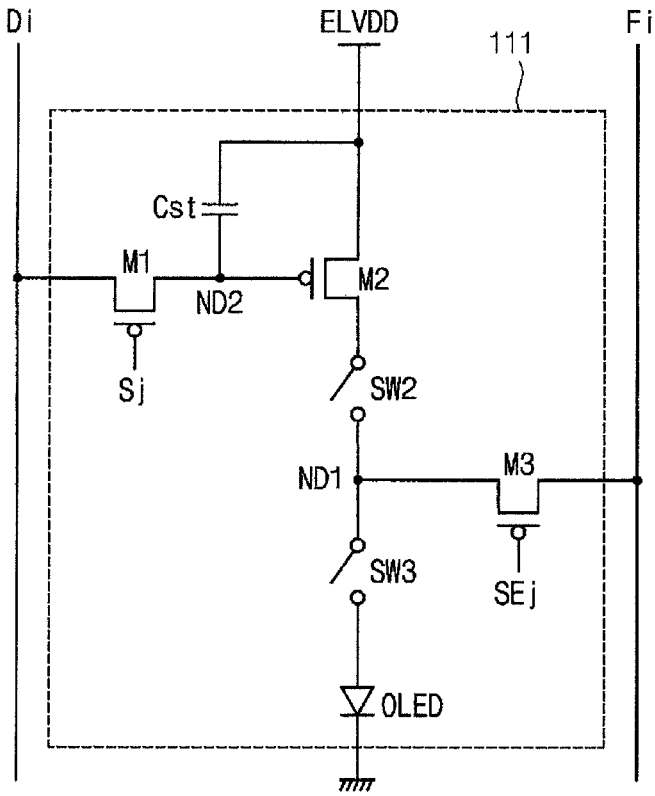
FIG. 2 is a circuit diagram illustrating an example of a pixel included in the organic light emitting display device of FIG. 1.

FIG. 2 is a circuit diagram illustrating an example of a pixel included in the organic light emitting display device of FIG. 1.

Referring to FIG. 2, the pixel 111 may include a switching transistor Ml, a storage capacitor Cst, a driving transistor M2, an organic light emitting diode OLED, and a sensing transistor M3. The pixel 111 may be electrically connected between an (i)th data line Di and an (i)th feedback line Fi, where i is a positive integer.

The switching transistor M1 may be electrically connected between the (i)th data line Di and a second node ND2 and may be turned on in response to a scan signal Sj.

The storage capacitor Cst may be electrically connected between the first power voltage ELVDD and the second node ND2. When the switching transistor M1 is turned on, the storage capacitor Cst may store the data signal provided through the (i)th data line Di.

The driving transistor M2 may transfer the organic light emitting diode OLED with a driving current in response to the data signal stored in the storage capacitor Cst.

The organic light emitting diode OLED may be electrically connected between a first node ND1 and the second power voltage ELVSS and may emit light in response to the driving current.

The sensing transistor M3 may be electrically connected between the (i)th feedback line Fi and the first node ND1 and may be turned on in response to the sensing control signal SEj.

In some example embodiments, the pixel 111 may further include a second switch SW2 and a third switch SW3. The second switch SW2 may be electrically connected between the driving transistor M2 and the first node ND1 and may be turned off during the first sensing period. Here, the first sensing period may be a period for sensing degradation information of the organic light emitting diode OLED as described above.

The third switch SW3 may be electrically connected between the first node ND1 and the organic light emitting diode OLED and may be turned off during the second sensing period. The third switch SW3 may be turned on during other periods except the second sensing period (e.g., the first sensing period and the display period).

The pixel 111 of FIG. 2 is illustrated by way of example. The pixel 111 is not limited thereto.

Figure 3A:
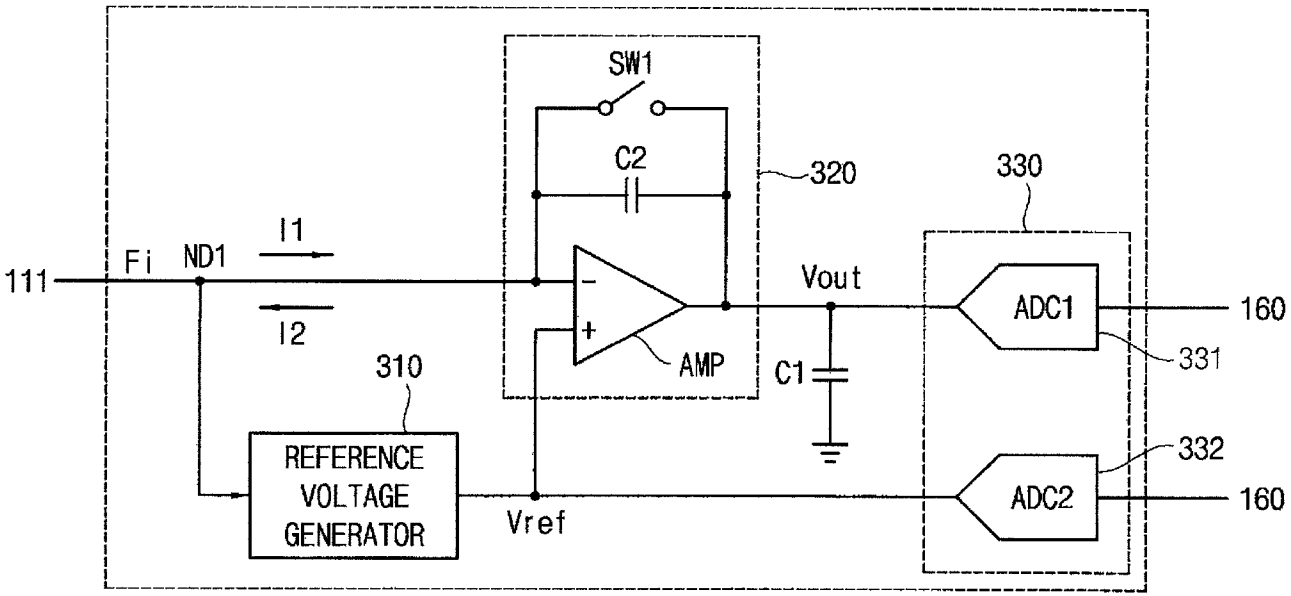
FIGS. 3A and 3B are block diagrams illustrating an example of a sensing unit included in the organic light emitting display device of FIG. 1.
Figure 3B:
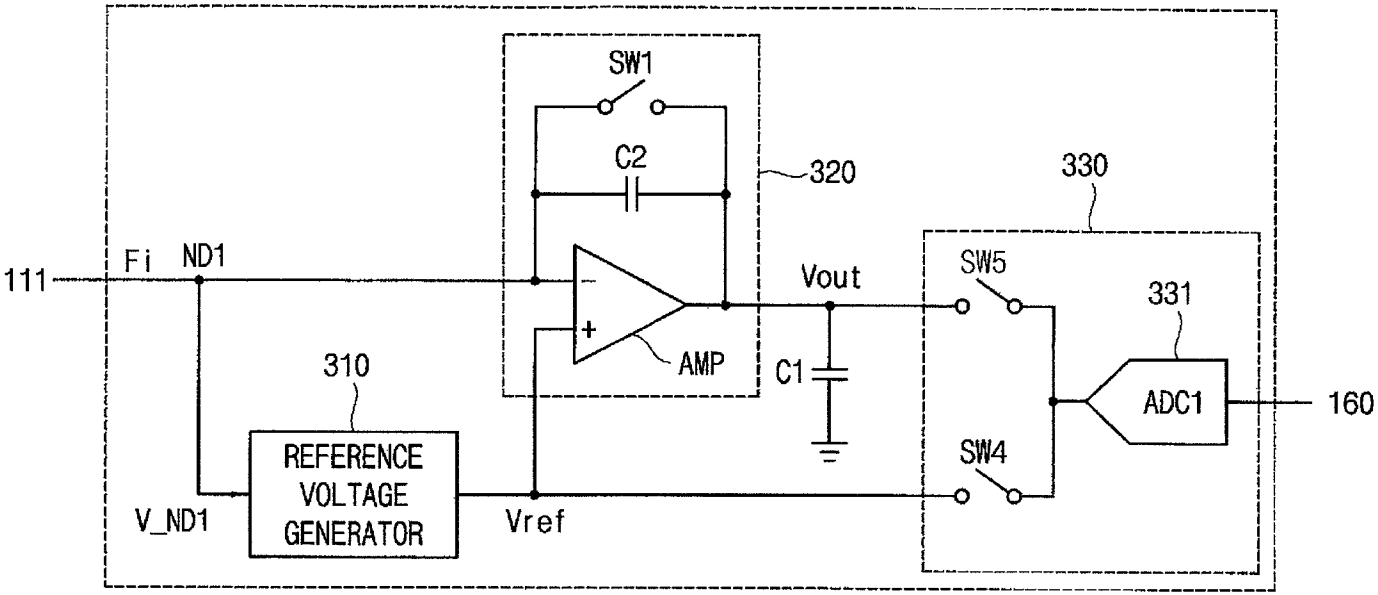

FIGS. 3A and 3B are block diagrams illustrating an example of a sensing unit included in the organic light emitting display device of FIG. 1.

Referring to FIGS. 2 and 3A, the sensing unit 150 may include a reference voltage generator 310, an integrator 320, and a converter 330.

The reference voltage generator 310 may generate the reference voltage Vref based on a first node voltage V_ND1 applied to the first node ND1 in response to the data signal, where the first node ND1 is electrically connected to the pixel 111 and the (i)th feedback line Fi. The reference voltage generator 310 may generate the reference voltage Vref based on the first node voltage V_ND1 during the display period.

According to some example embodiments of the present invention, the reference voltage generator 310 may sample the first node voltage V_ND1 and may output a sampled first node voltage V_ND1 as the reference voltage Vref. For example, the reference voltage generator 310 may sample the first node voltage V_ND1 at a start point of the first sensing period or at a start point of the second sensing period and may provide the integrator 320 with the sampled first node voltage V_ND1 as the reference voltage Vref. A configuration of the reference voltage generator 310 will be described in more detail with reference to FIGS. 4A through 4C.

The integrator 320 may integrate a sensing current (e.g., a first sensing current I1 or a second sensing current I2) flowing through the (i)th feedback line Fi according to the reference voltage Vref and may output an integrated sensing current (i.e., an output voltage Vout). The integrator 320 may include an amplifier AMP and a second capacitor C2. The amplifier AMP may include a first input terminal electrically connected to the (i)th feedback line Fi, a second terminal receiving the reference voltage Vref, and an output terminal electrically connected to the converter 330. The second capacitor C2 may be electrically connected between the first input terminal of the amplifier AMP and the output terminal of the amplifier AMP.

The integrator 320 may integrate the first sensing current I1 provided to the pixel 111 through the (i)th feedback line Fi. Here, the integrator 320 may operate as a current source. The integrator 320 may integrate the second sensing current I2 provided from the pixel 111 through the (i)th feedback line Fi.

In an example embodiment, the integrator 320 may further include a first switch SW1 that is electrically connected between the first input terminal of the amplifier AMP and the output terminal of the amplifier AMP. The first switch SW1 may be turned on during the reset period. The first switch SW1 may be used to reset (or, initialize) the integrator 320 during the reset period (e.g., the first switch SW1 may be used to discharge a stored voltage of the second capacitor C2 during the reset period).

According to some example embodiments of the present invention, the sensing unit 150 may further include a first capacitor C1 that stores the output voltage Vout of the amplifier AMP temporarily. The first capacitor C1 may be electrically connected between the output terminal of the amplifier AMP and a ground and may store the output voltage Vout temporarily during the first sensing period and/or the second sensing period.

The converter 330 may generate first sensing data based on the output voltage Vout and may generate second sensing data by digital-converting the reference voltage Vref. According to some example embodiments of the present invention, the converter 330 may include a first converter 331 that converts the output voltage Vout of the integrator 320 into the first sensing data. The first converter 331 may include a comparator that compares the output voltage Vout and a determined voltage (or, the reference voltage Vref). According to some example embodiments of the present invention, the converter 330 may further include a second converter 332 that generates the second sensing data by digital-converting the reference voltage Vref. The second converter 332 may convert the reference voltage Vref into the second sensing data.

As described above, the sensing unit 150 may sample a voltage across a feedback line (e.g., a node electrically connected to the pixel 111 and the feedback line) according to the data signal and may use a sampled voltage as the reference voltage Vref. Therefore, the sensing unit 150 may sense a characteristic of the pixel 111 at a plurality of operation points at which the pixel is actually driven.

Referring to FIG. 3B, the sensing unit 150 may be the same as or similar to the sensing unit 150 described in FIG. 3A, except the converter 330.

The converter 330 may include a first converter 331 converting an analog signal into a digital signal, a fourth switch SW4, and a fifth switch SW5. The first converter 331 may convert a voltage into sensing data (e.g., the first sensing data or the second sensing data), where the voltage is provided according to an operation of each of the fourth switch SW4 and the fifth switch SW5. For example, the fourth switch SW4 may be turned on during the first period (e.g., a start point of the first sensing period), and the first converter 331 may generate the first sensing data for the reference voltage Vref during the first period. For example, the fifth switch SW5 may be turned on during the second period (e.g., an end point of the first sensing period), and the first converter 331 may convert the output voltage Vout of the integrator 320 into the second sensing data. That is, the first converter 331 may perform a time-division operation.

The sensing unit 150 that includes the reference voltage generator 310, the integrator 320, and the converter 330 is illustrated in FIGS. 3A and 3B. However, the sensing unit 150 is not limited thereto. For example, the sensing unit 150 may include a plurality of sensing circuits that are electrically connected to the feedback lines F1 through Fm, respectively, and each of the plurality of the sensing circuits may include the reference voltage generator 310, the integrator 320, and the converter 330.

Figure 4A:
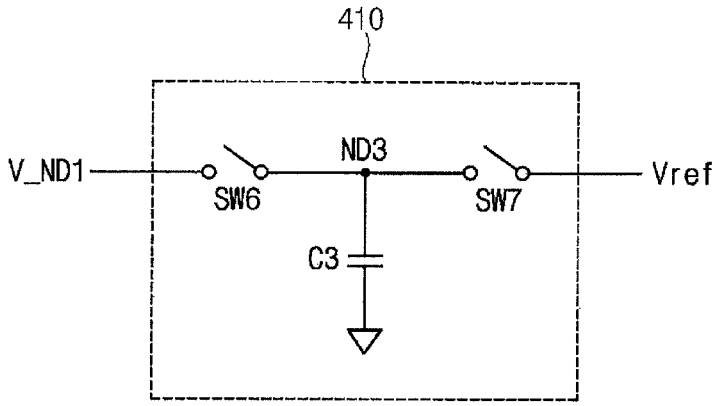
FIGS. 4A to 4C are block diagrams illustrating an example of a reference voltage generator included in the sensing unit of FIG. 3A.
Figure 4B:
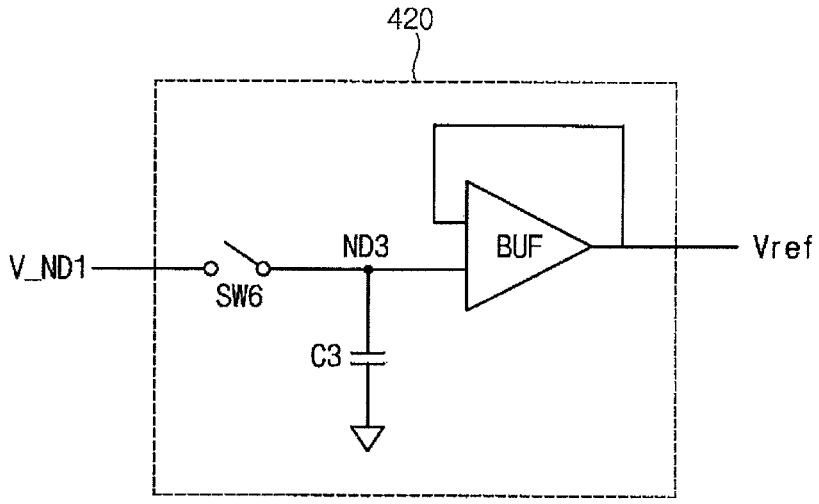
Figure 4C:
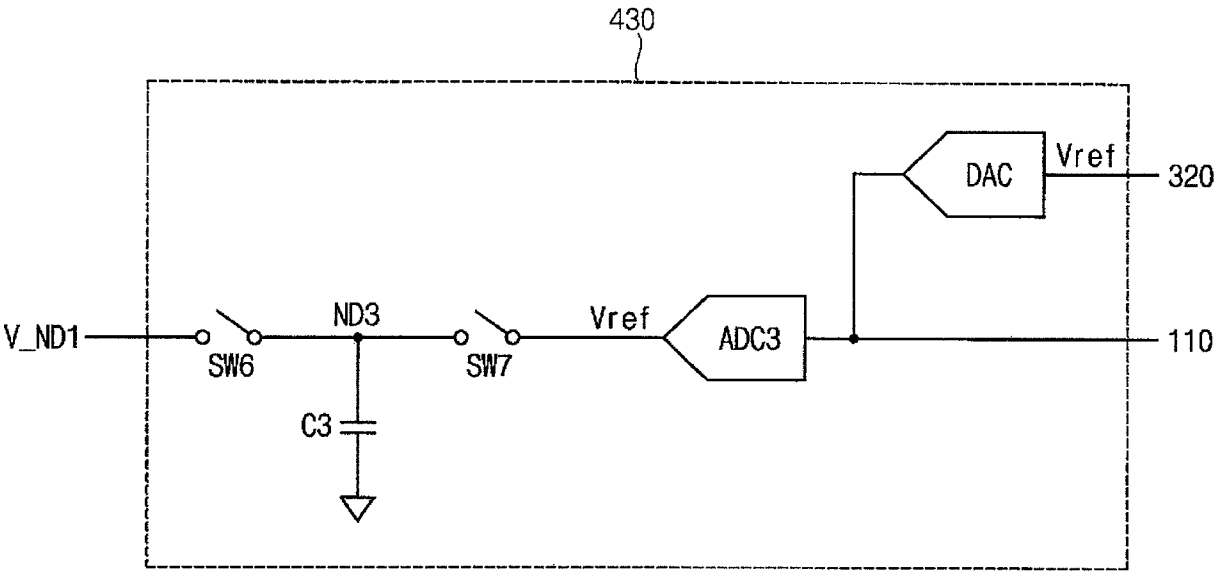

FIGS. 4A and 4C are block diagrams illustrating an example of a reference voltage generator included in the sensing unit of FIG. 3A.

Referring to FIGS. 3A and 4A, the reference voltage generator 410 may include a sixth switch SW6, a seventh switch SW7, and a third capacitor C3. The sixth switch SW6 may be electrically connected between the first node ND1 and a third node ND3 and may be turned on at a start point of the first period. The seventh switch SW7 may be electrically connected between the third node ND3 and the integrator 320 and may be turned on during the first period. The third capacitor C3 may be electrically connected between the third node ND3 and a ground and may the first node voltage V_ND1. For example, the third capacitor C3 may be charged with the first node voltage V_ND1 when the sixth switch SW6 is turned on. Here, the seventh switch SW7 may be turned off. Therefore, the reference voltage generator 410 may sample the first node voltage V_ND1. For example, the third capacitor C3 may output a stored first node voltage V_ND1 as the reference voltage Vref.

Referring to FIG. 4B, the reference voltage generator 420 may include the sixth switch SW6, the third capacitor C3, and a buffer amplifier BUF. The sixth switch SW6 may be electrically connected between the first node ND1 and the third node ND3 and may be turned on at a start point of the first period. The third capacitor C3 may be electrically connected between the third node ND3 and a ground and may store the first node voltage V_ND1. For example, the third capacitor C3 may be charged with the first node voltage V_ND1 when the sixth switch SW6 is turned on. Therefore, the reference voltage generator 420 may sample the first node voltage V_ND1. The buffer amplifier BUF may be electrically connected between the third node ND3 and the integrator 320 and may output the reference voltage Vref based on the first node voltage V_ND1 stored in the third capacitor C3.

Referring to FIGS. 4A and 4C, the reference voltage generator 430 may further include a third converter ADC3 and a fourth converter DAC, as compared to the reference voltage generator 410 illustrated in FIG. 4A. The third converter ADC3 may convert the reference voltage Vref into the first sensing data, where the reference voltage Vref is provided according to an operation of the seventh switch SW7. The third converter ADC3 may be the same as or similar to the second converter 332 described with reference to FIG. 3A. However, the third converter ADC3 may be included in the reference voltage generator 430. Although not illustrated in FIG. 4C, the sensing unit 150 may further include a memory and the first sensing data may be stored in the memory. The fourth converter DAC may generate the reference voltage Vref based on the first sensing data. For example, the fourth converter DAC may generate the reference voltage Vref based on the first sensing data stored in the memory.

Figure 5:
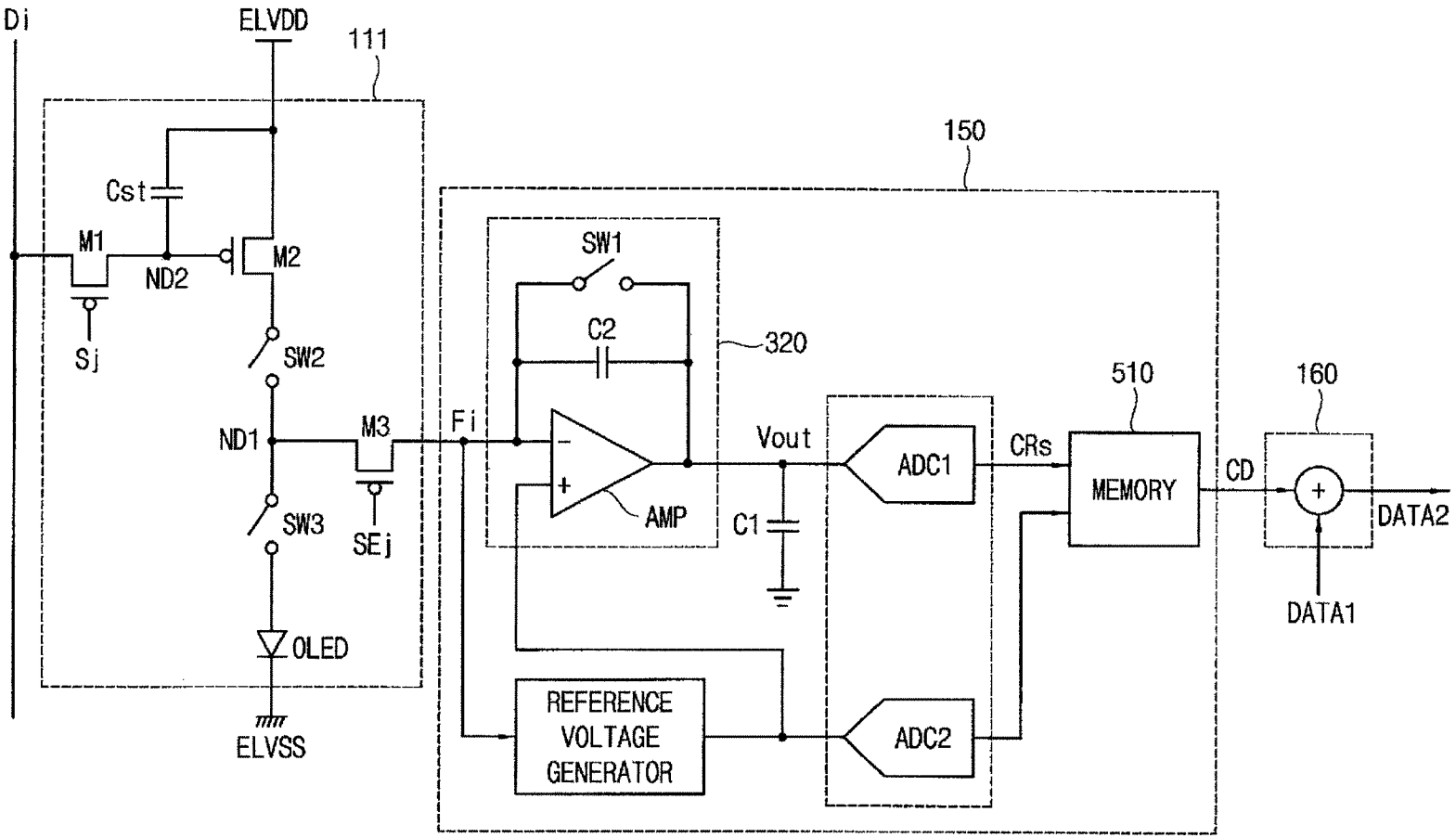
FIG. 5 is a circuit diagram illustrating an example of a pixel and a sensing unit included in the organic light emitting display device of FIG. 1.
Figure 6:
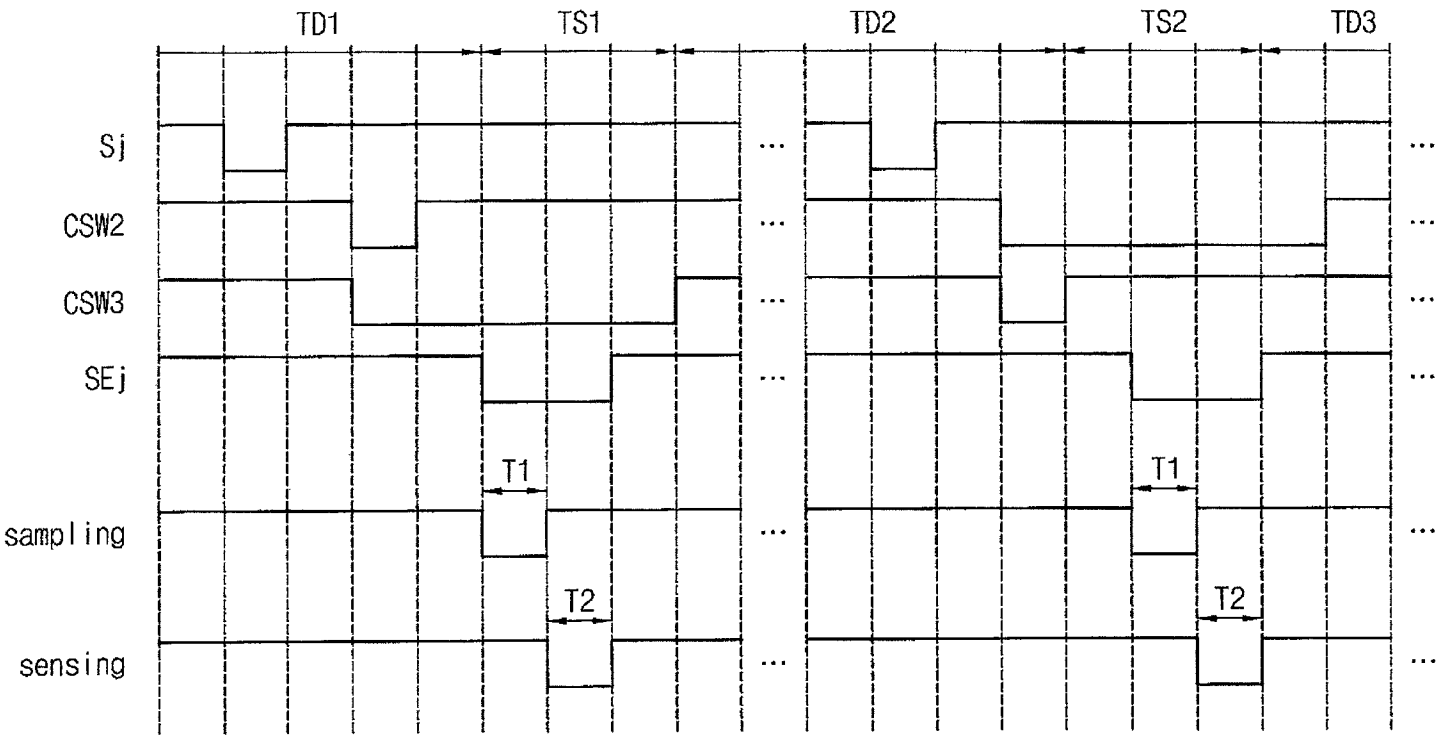
FIG. 6 is a waveform diagram illustrating an example of control signals generated by the organic light emitting display device of FIG. 1.

FIG. 5 is a circuit diagram illustrating an example of a pixel and a sensing unit included in the organic light emitting display device of FIG. 1. FIG. 6 is a waveform diagram illustrating an example of control signals generated by the organic light emitting display device of FIG. 1.

Referring to FIGS. 2, 3A, and 5, the pixel 111 and the sensing unit 150 may be the same as or similar to the pixel 111 of FIG. 2 and the sensing unit 150 of FIG. 3A, respectively. Therefore, some duplicated description may not be repeated.

Referring to FIGS. 5 and 6, in a first display period TD1, a (j)th scan signal Sj may have a logic low level, where j is a positive integer, and a second control signal CSW2 and a third control signal CSW3 may have a logic high level, respectively. Here, the second control signal CSW2 may control an operation of the second switch SW2, and the third control signal CSW3 may control an operation of the third switch SW3. Therefore, the switching transistor M1 may be turned on, and the data signal may be stored in the storage capacitor Cst of the pixel 111.

The second control signal CSW2 and the third control signal CSW3 may be changed from a logic high level to a logic low level, the second switch SW2 and the third switch SW3 may be turned on, respectively. Therefore, the pixel 111 may emit light in response to the data signal stored in the storage capacitor Cst.

In the first sensing period TS1, the second control signal CSW2 may have a logic high level, the third control signal CSW3 may have a logic low level, and a (j) sensing control line driving signal CSEj may have a logic low level. Here, the second switch SW2 may be turned on, the third switch SW3 may keep a turn-on state, and the sensing switch SEj may be turned on. Therefore, a current path between the sensing unit 150 and the second power voltage ELVSS may be formed, and the first sensing current I1 may flow through the (i)th feedback line (i.e., the first sensing current I1 may flow from the sensing unit 150 through the first node ND1 to second power voltage ELVSS).

In a first period T1 of the first sensing period TS1, the sensing unit 150 may generate the reference voltage Vref based on the first node voltage V_ND1 supplied to the (i)th feedback line Fi. For example, the reference voltage generator 310 may sample the first node voltage V_ND1 and provide the integrator 320 with a sampled first node voltage V_ND1 as the reference voltage Vref. In the first period T1, the integrator 320 may not operate. For example, the sensing unit 150 may include a switch located in a front end of the integrator 320, and the switch may be turned on in the first period T1 and may be turned off in the second period T2. In the first period T1 of the first sensing period TS1, the sensing unit 150 may generate the first sensing data for the reference voltage Vref.

In the second period T2 of the first sensing period TS1, the sensing unit 150 may generate the second sensing data based on the first sensing current I1. For example, the integrator 320 may integrate the first sensing current I1 during the second period T2 and may output an integrated sensing current I1 as the output voltage Vout. The first converter 331 may generate the second sensing data based on the output voltage Vout. The second sensing data may include degradation information of the organic light emitting diode OLED. For example, the first sensing current I1 is reduced according to a degradation of the organic light emitting diode OLED (e.g., the first sensing current I1 may have a lower current amount than a current amount of the first sensing current I1 that is sensed when the organic light emitting diode OLED is not degraded), and the second sensing data may be changed according to a change of the first sensing current I1.

An operation of the organic light emitting display device 100 in a second display period TD2 may be the same as or similar to an operation of the organic light emitting display device 100 in the first display period TD1. Therefore, some duplicated description may not be repeated.

In the second sensing period TS2, the second control signal CSW2 may have a logic low level, the third control signal CSW3 may have a logic high level, and the (j)th sensing control line driving signal CSEj may have a logic low level. Here, the second switch SW2 may keep a turn-on state, the third switch SW3 may be turned off, and the sensing switch SEj may be turned on. Therefore, a current path between the first power voltage ELVDD and the sensing unit 150, and the second sensing current I2 may flow through the (i)th feedback line Fi (e.g., the second sensing current I2 may flow from the first power voltage ELVDD through the first node ND1 to the sensing unit 150).

In the first period T1 of the second sensing period TS2, the sensing unit 150 may generate the reference voltage Vref based on the first node voltage V_ND1 supplied to the (i)th feedback line Fi. A configuration of generating the reference voltage Vref may be the same as or similar to a configuration of generating the reference voltage Vref in the first period T1 of the first sensing period TS1.

In the second period T2 of the second sensing period TS2, the sensing unit 150 may generate the second sensing data based on the second sensing current I2. For example, the integrator 320 may integrate the second sensing current I2 during the second period T2 and may output an integrated second sensing current I2 as the output voltage Vout. The first converter 331 may generate the second sensing data based on the output voltage Vout. Here, the second sensing data may include threshold voltage/mobility information of the driving transistor M2. For example, the second sensing current I2 may be changed according to a degradation of the driving transistor M2, and the second sensing data may be changed according to a change of the second sensing current I2.

The sensing unit 150 generating the reference voltage Vref in the first period T1 is illustrated in FIG. 6. However, the sensing unit 150 is not limited thereto. For example, the sensing unit 150 may generate the reference voltage Vref in the display period TD1 and TD2.

Figure 7:
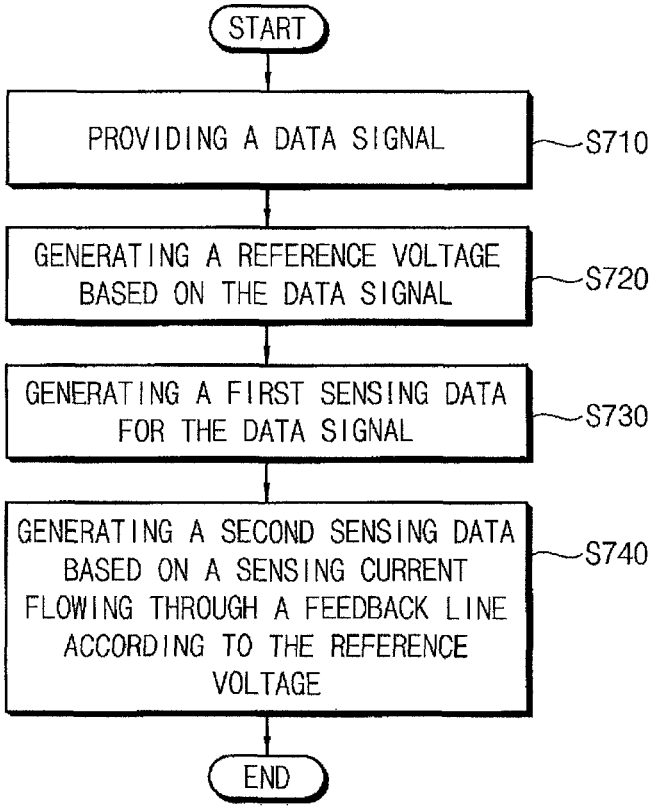
FIG. 7 is a flowchart illustrating a method of driving an organic light emitting display device according to some example embodiments of the present invention.

FIG. 7 is a flowchart illustrating a method of driving an organic light emitting display device according to some example embodiments of the present invention.

Referring to FIGS.1, 5, and 7, a method of driving an organic light emitting display device may drive the organic light emitting display device 100 including a pixel 111 in an intersection of a data line Di, a feedback line Fi, and a scan line Si.

The method of FIG. 7 may provide a data signal to the pixel 111 through the data line Di (S710).

The method of FIG. 7 may generate a reference voltage Vref based on the data signal (S720). For example, the method of FIG. 7 may generate the reference voltage Vref based on a first node voltage V_ND1 across a node (e.g., the first node ND1) according to the data signal, where the node is electrically connected to the pixel 111 and the feedback line Fi.

For example, the method of FIG. 7 may sample the first node voltage V_ND1 and may output a sampled first node voltage V_ND1 as the reference voltage Vref.

The method of FIG. 7 may generate first sensing data for the reference voltage Vref (S730) and may generate second sensing data based on a sensing current (e.g., a first sensing current I1 or a second sensing current I2) that flows according to the reference voltage Vref (S740).

For example, the method of FIG. 7 may concurrently (e.g., simultaneously) generate the first sensing data and the second sensing data using converters (e.g., a first converter ADC1 and a second converter ADC2) included in the organic light emitting display device 100.

For example, the method of FIG. 7 may generate the first sensing data based on the reference voltage Vref in the first period T1 and may generate the second sensing data based on the output voltage Vout generated by integrating a sensing current (e.g., the first sensing current I1 or the second sensing current I2) in the second period T2. Here, the first period T1 is separated from the second period T2. That is, the method of FIG. 7 may generate the first sensing data and the second sensing data sequentially.

The method of FIG. 7 may generate a compensation data CD base on the first sensing data and the second sensing data, where the compensation data CD may be used to compensate a degradation of the organic light emitting diode OLED and a threshold voltage/mobility of the driving transistor M2 included in the pixel 111.

As described with reference to FIG. 6, the second sensing data may include the degradation information of the organic light emitting diode OLED or the threshold voltage/mobility information of the driving transistor M2. The organic light emitting display device 100 may include the memory 510 storing compensation data (e.g. predetermined or pre-calculated compensation data). Therefore, the method of FIG. 7 may adjust (or, update) the compensation data stored in the memory 510 based on the first sensing data and the second sensing data.

As described above, a method of driving an organic light emitting display device according to example embodiments may generate the reference voltage Vref based on the data signal and may sense a characteristic of the pixel 111 (e.g., the degradation information of the organic light emitting diode OLED or the threshold voltage/mobility information of the driving transistor M2) based on the reference voltage Vref. In addition, the method may not provide a sensing voltage to the pixel 111 to sense a characteristic of the pixel 111 in an initialization period but may use the data signal supplied during the display period as the sensing voltage. Therefore, the method may reduce a sensing time and may sense the characteristics of the pixel 111 in real time.

The present inventive concept may be applied to a display device (e.g., an organic light emitting display device, a liquid crystal display device, etc.) including a gate driver. For example, aspects of embodiments of the present invention may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and characteristics of example embodiments of the present invention. Accordingly, all such modifications are intended to be included within the scope of example embodiments as defined in the claims, and their equivalents. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. An organic light emitting display device comprising:

a display panel comprising a pixel at an intersection of a data line, a feedback line, and a scan line;

a data driver configured to provide a data signal to the pixel through the data line to enable the pixel to emit light according to the data signal;

a sensing unit configured to generate a reference voltage based on the data signal, to generate first sensing data based on a sensing current that flows through the feedback line in response to the reference voltage, and to generate second sensing data by digital-converting the reference voltage; and a timing controller configured to generate compensation data based on the first sensing data and the second sensing data.

2. The display device of claim 1, wherein the sensing unit is configured to generate the reference voltage based on a node voltage at a node electrically connected to the pixel and the feedback line.

3. The display device of claim 2, wherein the sensing unit comprises:

a reference voltage generator configured to generate the reference voltage based on the node voltage;

an integrator configured to integrate the sensing current; and a first converter configured to convert an output signal of the integrator into the first sensing data.

4. The display device of claim 3, wherein the reference voltage generator is configured to sample the node voltage and to output a sampled node voltage as the reference voltage.

5. The display device of claim 4, wherein the reference voltage generator comprises a capacitor configured to store the node voltage.

6. The display device of claim 4, wherein the reference voltage generator comprises a buffer amplifier configured to receive the node voltage and to output the reference voltage.

7. The display device of claim 3, wherein the sensing unit further comprises:

a second converter configured to generate the first sensing data.

8. The display device of claim 3, wherein the first converter is configured to generate the first sensing data in a first period and to generate the second sensing data in a second period different from the first period.

9. The display device of claim 3, wherein the integrator comprises:

an amplifier comprising a first input terminal that is electrically connected to the feedback line, a second input terminal configured to receive the reference voltage, and an output terminal that is electrically connected to the first converter; and a second capacitor electrically connected between the first input terminal and the output terminal.

10. The display device of claim 9, wherein the integrator further comprises:

a first switch electrically connected between the first input terminal and the output terminal, wherein the first switch is configured to be turned on in a reset period to discharge the second capacitor.

11. The display device of claim 1, wherein the pixel comprises:

an organic light emitting diode electrically connected between a first node and a second power voltage;

a switching transistor electrically connected between the data line and a second node, wherein the switching transistor is configured to be turned on in response to a scan signal;

a storage capacitor electrically connected between a first power voltage and the second node;

a driving transistor configured to provide the organic light emitting diode with a current based on a stored voltage in the storage capacitor; and a sensing transistor electrically connected between the feedback line and the first node, wherein the sensing transistor is configured to be turned on in response to a sensing control signal.

12. The display device of claim 11, wherein the pixel further comprises a second switch electrically connected between the driving transistor and the first node, wherein the second switch is configured to be turned on in a first sensing period.

13. The display device of claim 11, wherein the pixel further comprises a third switch electrically connected between the first node and the organic light emitting diode, wherein the third switch is configured to be turned on in a second sensing period.

14. The display device of claim 1, wherein the timing controller generates the compensation data to compensate degradation information of an organic light emitting diode of the pixel and deviation information of a threshold voltage of a driving transistor of the.

15. The display device of claim 14, wherein the timing controller comprises a memory configured to store the compensation data and is configured to correct the compensation data based on the first sensing data and the second sensing data.

16. A method of driving an organic light emitting display device comprising a pixel at an intersection of a data line, a feedback line, and a scan line, the method comprising:

providing a data signal to the pixel through the data line to enable the pixel to emit light according to the data signal;

generating a reference voltage based on the data signal;

generating second sensing data for the reference voltage;

generating first sensing data based on a sensing current that flows through the feedback line in response to the reference voltage; and generating compensation data based on the first sensing data and the second sensing data.

17. The method of claim 16, wherein the reference voltage is generated based on a node voltage applied to a node electrically connected to the pixel and the feedback line in response to the data signal.

18. The method of claim 17, wherein generating the reference voltage comprises:

sampling the node voltage; and outputting a sampled node voltage as the reference voltage.

19. The method of claim 16, wherein the second sensing data is generated in a first period and the first sensing data is generated based on the sensing current in a second period different from the second period.

20. The method of claim 16, wherein the compensation data is generated to compensate degradation information of an organic light emitting diode of the pixel and deviation information of a threshold voltage of a driving transistor of the pixel.

* * * * *